US007900590B2

(12) United States Patent
Cleveland et al.

(10) Patent No.: US 7,900,590 B2
(45) Date of Patent: Mar. 8, 2011

(54) METHODS AND LUBRICANT AND FUEL COMPOSITIONS FOR TWO-STROKE ENGINE CONTAINING POWER VALVES

(75) Inventors: William K. S. Cleveland, Mentor-on-the-Lake, OH (US); Laimute R. Svarcas, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 998 days.

(21) Appl. No.: 10/511,248

(22) PCT Filed: Apr. 17, 2003

(86) PCT No.: PCT/US03/12090

§ 371 (c)(1), (2), (4) Date: Oct. 13, 2004

(87) PCT Pub. No.: WO03/089556

PCT Pub. Date: Oct. 30, 2003

(65) Prior Publication Data

US 2005/0139174 A1 Jun. 30, 2005

Related U.S. Application Data

(60) Provisional application No. 60/373,988, filed on Apr. 19, 2002.

(51) Int. Cl.

| | |
|---|---|
| ***F02B 43/00*** | (2006.01) |
| ***C10M 169/04*** | (2006.01) |
| ***C10L 1/02*** | (2006.01) |

(52) U.S. Cl. ..... 123/1 A; 508/522; 508/454; 508/554; 508/542; 44/330; 44/427

(58) Field of Classification Search ..... 508/522, 508/454, 551, 554, 542; 44/58, 75, 73, 330, 44/427; 123/1 A See application file for complete search history.

(56) References Cited

U.S. PATENT DOCUMENTS

| | | | | |
|---|---|---|---|---|
| 3,772,359 | A | 11/1973 | Schlobohm et al. | |
| 4,425,138 | A | 1/1984 | Davis | |
| 4,705,643 | A | 11/1987 | Nemo | |
| 5,741,764 | A * | 4/1998 | Patel et al. | 508/459 |
| 5,888,948 | A | 3/1999 | Meny et al. | |
| 6,242,394 | B1 * | 6/2001 | Chamberlin, III | 508/549 |
| 6,391,833 | B1 * | 5/2002 | Ilmain et al. | 508/518 |
| 2004/0083729 | A1 * | 5/2004 | Teacherson | 60/517 |

FOREIGN PATENT DOCUMENTS

| | | |
|---|---|---|
| WO | 93/03120 A1 | 2/1993 |
| WO | 94/06897 A1 | 3/1994 |
| WO | 00/14185 A1 | 3/2000 |

* cited by examiner

*Primary Examiner* — Glenn A Caldarola
*Assistant Examiner* — Vishal Vasisth
(74) *Attorney, Agent, or Firm* — Christopher D. Hilker; David M. Shold

(57) ABSTRACT

Methods, a lubricant composition, and a fuel composition for lubricating a two-stroke internal combustion engine include a lubricant composition that contains (A) an oil of lubricating viscosity, (B) an additive composition, and (C) a normally liquid solvent having a kinematic viscosity of less than 5 cSt at 100° C. The lubricant composition improves the cleanliness of a power valve of a two-stroke engine.

8 Claims, No Drawings

METHODS AND LUBRICANT AND FUEL COMPOSITIONS FOR TWO-STROKE ENGINE CONTAINING POWER VALVES

This application is a 371 of PCT/US03/12090, filed Apr. 17, 2003.

This application claims the benefit of the U.S. Provisional Application 60/373,988 filed 19 Apr. 2002.

BACKGROUND OF THE INVENTION

1. Field of the Invention

The present invention involves methods, a lubricant composition, and a fuel composition for use in a two-stroke internal combustion engine. The methods and lubricant and fuel compositions are effective in improving the cleanliness of power valves in a two-stroke engine having a variable exhaust timing system.

2. Description of the Related Art

Additives that maintain or improve cleanliness in two-stroke internal combustion engines, especially those equipped with power valves, are essential for the durability and satisfactory performance of the engine.

The overall driving force behind introducing power valves into a two-stroke engine is the customer's desire for more power. The most cost effective way to increase power over the entire rpm range, without major engine modifications and without negatively affecting the excellent power to weight ratio in a two-stroke engine, is to incorporate power valves in a system in which the timing for the exhaust step varies with engine conditions. The power output characteristics of a two-stroke engine are, in part, determined by the location of the top of the exhaust port. A low port height provides an engine with good low-end output, whereas a high port height provides better peak horsepower. The use of a power valve enables the engine to have both characteristics, good low end power with good peak output, by accurately setting the timing for opening and closing the power valve. This timing is established by overlaying the power curves of a low exhaust port and high exhaust port engine design, then finding the "cross-over" RPM where the power curves meet. This is the RPM at which the valves are opened and closed. Power valves are retracted or extended based on engine speed and load by mechanical pressure or electronic servo-motor activated systems. Some of the more sophisticated systems incorporate programmed auto-cleaning cycles and may include control by other engine or external parameters. In order to insure that power valves operate well, carbon build-up and gumming must be inhibited and/or eliminated. Various manufacturers refer to power valves and/or the system to activate them by a variety of names to include exhaust port valves, variable exhaust timing systems, exhaust port modifiers, arctic power valves, variable exhaust valves, variable exhaust systems and rotax adjustable variable exhaust (RAVE).

International Publication No. WO 00/14185 discloses a two-cycle oil and a fuel comprising such an oil where the oil consists of a polyisobutylene amine, a nitrogen-containing dispersant, a polybutene polymer, a solvent, and a lubricating oil and exhibits improved performance and does not contribute to the clogging of variable exhaust systems.

The methods, lubricant composition, and fuel composition of the present invention are unexpectedly effective in inhibiting and/or eliminating carbon buildup, clogging and gumming of power valves. This improved power valve cleanliness is achieved in addition to maintaining and/or improving overall two-cycle engine performance. Test evaluations in a two-stroke engine containing power valves hereinbelow demonstrate the unexpected effectiveness of the present invention.

SUMMARY OF THE INVENTION

An object of the present invention is to improve the cleanliness of a two-stroke internal combustion engine containing a power valve.

Another object of the invention is to improve the performance of a two-stroke internal combustion engine containing a power valve.

A further object of this invention is to improve the cleanliness of a two-stroke internal combustion engine.

A still further object of the invention is to improve the performance of a two-stroke internal combustion engine.

Additional objects and advantages of the present invention will be set forth in the Detailed Description that follows and, in part, will be obvious from the Detailed Description or may be learned by the practice of the invention. The objects and advantages of the invention may be realized by means of the instrumentalities and combinations pointed out in the appended claims.

To achieve the foregoing objects in accordance with the invention, as described and claimed herein, a method for lubricating a two-stroke internal combustion engine containing a power valve comprises supplying to the engine a lubricant composition that comprises (A) an oil of lubricating viscosity; (B) an additive composition that comprises (1) a reaction product of a fatty hydrocarbyl-substituted monocarboxylic acylating agent and a reactive nitrogen-containing compound selected from the group consisting of ammonia, a monoamine, a polyamine, an alkanolamine, and a thiol-containing amine, and a mixture thereof wherein the reaction product of the acylating agent and the polyamine comprises a heterocyclic reaction product; and (2) a member selected from the group consisting of (a) a hydrocarbyl-substituted aminophenol; (b) a Mannich reaction product of a hydrocarbyl-substituted phenol, an aldehyde, and an amine; (c) a reaction product of a hydrocarbyl-substituted polycarboxylic acylating agent and a polyamine; and (d) a mixture thereof; and (C) a normally liquid solvent having a kinematic viscosity of less than 5 cSt at 100° C. where the lubricant composition improves the cleanliness of the power valve.

In an embodiment of the method of the present invention for lubricating the two-stroke engine containing a power valve, the lubricant composition is mixed with a liquid fuel, the mixture of the lubricant composition and the fuel is supplied to the engine, and the weight ratio of the fuel to the lubricant composition in the mixture is 10-250:1.

In another embodiment of the invention a lubricant composition for lubricating a two-stroke internal combustion engine comprises (A) an oil of lubricating viscosity; (B) an additive composition comprising (1) a reaction product of a fatty hydrocarbyl-substituted monocarboxylic acylating agent and a polyamine, an alkanolamine, a thiol-containing amine, or a mixture thereof wherein the reaction product comprises a hetero-cyclic reaction product; and (2) a hydrocarbyl-substituted aminophenol; and (C) a normally liquid solvent having a kinematic viscosity of less than 5 cSt at 100° C. wherein the amount of the component (B)(1) is greater than 3.4% by weight, and the amount of components (B)(1) and (B)(2) combined is greater than 9.6% by weight.

In a further embodiment of the invention a fuel composition comprises a liquid fuel; and a lubricating amount of the lubricant composition for lubricating a two-stroke internal combustion engine.

DETAILED DESCRIPTION OF THE INVENTION

A method of the present invention for lubricating a two-stroke internal combustion engine containing a power valve comprises supplying to the engine a lubricant composition comprising (A) an oil of lubricating viscosity; (B) an additive composition comprising (1) a reaction product of a fatty hydrocarbyl-substituted monocarboxylic acylating agent and a reactive nitrogen-containing compound selected from the group consisting of ammonia, a monoamine, a polyamine, an alkanolamine, a thiol-containing amine, and a mixture thereof wherein the reaction product of the acylating agent and polyamine comprises a heterocyclic reaction product; and (2) a member selected from the group consisting of (a) hydrocarbyl-substituted aminophenol; (b) a Mannich reaction product of a hydrocarbyl-substituted phenol, an aldehyde, and an amine; (c) a reaction product of a hydrocarbyl-substituted polycarboxylic acylating agent and a polyamine; and (d) a mixture thereof; and (C) a normally liquid solvent having a kinematic viscosity of less than 5 cSt at 100° C. wherein the lubricant composition improves the cleanliness of the power valve.

The method of the present invention involves lubricating a two-stroke internal combustion engine that contains a power valve. As described hereinabove in the Background of the Invention section, a power valve and a system to activate the power valve comprise exhaust port valves in the cylinders of the engine and a means to activate or move the exhaust port valves in order to increase the power output of the engine. The exhaust port valves are moved based on the engine speed and load to vary the opening of the exhaust ports to give more time for combustion step at low engine speeds and more time for the exhaust step at high engine speeds. In order that the power valve and the system that activates the valve operate properly to increase the power output of the engine, cleanliness of the activating system and especially the power valve is required.

The two-stroke internal combustion engine of the present invention can be lubricated by supplying to the engine a lubricant composition as a component of a fuel composition. The lubricant composition can be added to a liquid fuel to form the fuel composition, commonly referred to as a premix, prior to adding the fuel composition to a fuel tank of a vehicle or equipment powered by the two-stroke engine or the lubricant composition can be injected from a lubricating system of the vehicle or equipment into the liquid fuel in a fuel system of the engine to form the fuel composition before the fuel composition enters a combustion chamber in a cylinder of the engine. In another embodiment of the invention the two-stroke engine can be lubricated by supplying to the engine the lubricant composition by direct injection of the lubricant composition from a lubricating system of a vehicle or equipment powered by the engine into a combustion chamber in a cylinder of the engine.

The oil of lubricating viscosity of the lubricant composition of the present invention can be a natural oil, a synthetic oil, or a mixture thereof. The oil of lubricating viscosity can have a Brookfield viscosity ranging from a maximum of 3500 centipoise (cP) at 0° C. for tropical climates to a maximum of 17,000 cP at −40° C. for arctic climates. The oil of lubricating viscosity is usually present in the lubricant composition in a major amount although it can be present as a few percent by weight so it can range from 1 to 99% by weight. Typically the oil of lubricating viscosity can be present in the lubricant composition at 30 to 95% by weight, in another instance at 40 to 85% by weight, and in other instances at 55 to 80% and 60 to 75% by weight. Natural oils can include mineral oils from various sources such as a petroleum crude or a refined petroleum oil, animal oils, and vegetable oils. Useful mineral oils include oils from the American Petroleum Institute Base Oil Groups I, II, III, and V. Synthetic oils can include polyolefins and hydrogenated polyolefins such as a hydrogenated poly(1-alkene), esters of carboxylic acids, alkylated aromatic compounds such an alkylbenzene or dialkylbenzene, and polymers of alkylene oxides to include carboxylic acid ester and ether derivatives thereof such as a dialkyl ether of a high molecular weight poly(ethylene glycol). Polyolefins can include homopolymers from a single olefin monomer, copolymers from two or more olefin monomers, or mixtures thereof. Olefin monomers can include alkenes, especially 1-alkenes, and dienes, and can have 2 to 18 carbon atoms. Useful olefin monomers include ethylene, propylene, butenes such as isobutylene, 1-octene, 1-decene, isoprene, and 1,3-butadiene. Useful polyolefins include polyisobutylenes, poly(1-alkene)s such as a poly(1-decene), and ethylene-propylene copolymers. The esters of carboxylic acids can be derived from an aliphatic carboxylic acid, an aromatic carboxylic acid, or mixtures thereof. Aliphatic carboxylic acids can be monobasic with one acid group or polybasic with two or more acid groups, can be linear or branched, can be saturated or unsaturated, and include acids having 1 to 22 carbon atoms. Useful aliphatic carboxylic acids include valeric acid, octanoic acid, isostearic acid, oleic acid, adipic acid, and azelaic acid. Aromatic carboxylic acids can be monocarboxylic acids or polycarboxylic acids having two or more acid groups, and can include acids having 7 to 17 carbon atoms. Useful aromatic carboxylic acids include benzoic acid and the anhydrides of phthalic acid and trimellitic acid. The esters of carboxylic acids can be derived from a monohydric alcohol, a polyhydric alcohol, or mixtures thereof. The monohydric alcohol can be linear or branched, can be saturated or unsaturated, and includes alcohols having 1 to 22 carbon atoms. Useful monohydric alcohols can include 2-ethyl-1-hexanol, isooctyl alcohol, isodecyl alcohol, and tridecyl alcohol. The polyhydric alcohol can have two or more hydroxyl groups, and can be linear or branched. Useful polyhydric alcohols can include polyols such as trimethylolpropane and mono- and di- and tripentaerythritol, glycols such as ethylene glycol and neopentyl glycol, and polyalkylene glycols such as di(ethylene glycol) and tri(ethylene glycol) and higher poly(ethylene glycol)s of various molecular weights. The esters of carboxylic acids can be prepared by esterification methods from a carboxylic acid and an alcohol or a mixture of one or more carboxylic acids and one or more alcohols. In an embodiment of the invention the esters of carboxylic acids are prepared by mixing two or more carboxylic acid esters where each ester was prepared separately from the other ester or esters. Useful esters of carboxylic acids can include diesters of a monohydric alcohol and a dibasic carboxylic acid such as di-isodecyl azelate and polyol esters of a monobasic carboxylic acid and a polyhydric alcohol such as esters of a $C_5$ to $C_{18}$ carboxylic acid and trimethylolpropane.

The additive composition of the lubricant composition of the present invention comprises (B)(1) a reaction product of a fatty hydrocarbyl-substituted monocarboxylic acylating agent and a reactive nitrogen-containing compound selected from the group consisting of ammonia, a monoamine, a polyamine, an alkanolamine, a thiol-containing amine, and a mixture thereof wherein the reaction product of the acylating agent and the polyamine comprises a heterocyclic reaction product. Throughout this application the term hydrocarbyl represents a univalent group of one or more carbon atoms that is predominately hydrocarbon in nature, but can contain heteroatoms such as oxygen in the carbon chain and can have nonhydrocarbon and heteroatom-containing groups such as hydroxy, halo, nitro and alkoxy attached to the carbon chain. The hydrocarbyl substituent of the fatty hydrocarbyl-substituted monocarboxylic acylating agent of the (B)(1) reaction product can be an aliphatic group. The aliphatic group can be linear, branched, or a mixture thereof. The aliphatic group can be saturated, unsaturated, or a mixture thereof. The aliphatic group can have 1 to 50 carbon atoms, in another instance 2 to 30 carbon atoms, and in a further instance 4 to 22 carbon atoms. The monocarboxylic acylating agent of the (B)(1) reaction product can be a monocarboxylic acid or a reactive equivalent thereof to include an anhydride, an ester, or an acid halide such as stearoyl chloride. Useful monocarboxylic acylating agents are available commercially from numerous suppliers and include tall oil fatty acids, oleic acid, stearic acid and isostearic acid. The reactive nitrogen-containing compound of the (B)(1) reaction product includes one or more reactive groups capable of reacting with the monocarboxylic acylating agent in a condensation reaction to form for example an amide reaction product in the case of a monoamine or an amide and/or ester and/or heterocyclic reaction product in the case of an alkanolamine.

The reactive nitrogen-containing compound can be a monoamine having one amine group and includes primary and secondary monoamines such as methylamine and dimethylamine. The monoamine can have 1 to 30 carbon atoms.

The reactive nitrogen-containing compound can be a polyamine having two or more amine groups where a first amine group is a primary amine group and a second amine group is a primary or secondary amine group, and the reaction product of the monocarboxylic acylating agent and the polyamine containing the first and second amine groups comprises a heterocyclic reaction product such as for example 2-imidazoline reaction products. The polyamine can have 2 to 30 carbon atoms. The polyamine can include alkylenediamines, N-alkyl alkylenediamines, and poly-alkylenepolyamines. Useful polyamines include ethylenediamine, 1,2-diaminopropane, N-methylethylenediamine, N-tallow($C_{16}$-$C_{18}$)-1,3-propylenediamine, N-oleyl-1,3-propylenediamine, polyethylenepolyamines such as diethylenetriamine and triethylenetetramine and tetraethylenepentamine and polyethylenepolyamine bottoms. The heterocyclic reaction product can be present in the (B)(1) reaction product at 1 to 100% by weight, in another instance at 5 to 80% by weight, and in a further instance at 10 to 60% by weight. In an embodiment of the invention the reactive nitrogen-containing compound of the (B)(1) reaction product is a polyamine. In another embodiment of the invention the monocarboxylic acylating agent and the polyamine of the (B)(1) reaction product are respectively a $C_4$ to $C_{22}$ fatty carboxylic acid and an alkylenediamine or a polyalkylenepolyamine, and in a further embodiment the fatty carboxylic acid is isostearic acid and the polyamine is a polyethylenepolyamine.

The reactive nitrogen-containing compound can be an alkanolamine having at least one amine group and at least one hydroxyl group where the amine group can be a primary, secondary or tertiary amine group. The alkanolamine can have 2 to 30 carbon atoms. The alkanolamine can include mono-, di- and trialkoxylates of ammonia such as mono- and di- and triethanolamine, hydroxy-containing monoamines such as a diethoxylated $C_{16}$ to $C_{18}$ tallowamine, and hydroxy-containing polyamines such as 2-(2-aminoethylamino)ethanol. In another embodiment of the invention the alkanolamine can react with the monocarboxylic acylating agent to form a reaction product that comprises a heterocyclic reaction product such as for example 2-oxazoline and 2-imidazoline reaction products. This alkanolamine, that reacts with the acylating agent to form the heterocyclic reaction product, can have at least one hydroxyl group and at least one amine group where the at least one amine group is a primary amine group or can have at least one hydroxyl group and at least two amine groups where one of the amine groups is a primary amine group and a second amine group is a primary or secondary amine group. This alkanolamine, that reacts with the acylating agent to form the heterocyclic reaction product, can have 2 to 30 carbon atoms and can include hydroxy-containing monoamines such as ethanolamine and tris(hydroxymethyl) aminomethane and hydroxy-containing polyamines such as 2-(2-aminoethylamino)ethanol.

The reactive nitrogen-containing compound can be a thiol-containing amine having at least one thiol group and at least one amine group where the amine group can be a primary, secondary or tertiary amine group. The thiol-containing amine can have 2 to 30 carbon atoms and can include thiol-containing monoamines and thiol-containing polyamines such as 2-aminoethanethiol and 2-(dimethylamino) ethanethiol. In an embodiment of this invention the thiol-containing amine reacts with the monocarboxylic acylating agent to form a reaction product that comprises a heterocyclic reaction product such as for example 2-thiazoline and 2-imidazoline reaction products. The thiol-containing amine, that reacts with the acylating agent to form the heterocyclic reaction product, can contain at least one thiol group and at least one amine group that is a primary amine group such as 2-aminoethanethiol or can contain at least one thiol group and at least two anine groups where one of the amine groups is primary and the other amine group is primary or secondary.

The monocarboxylic acylating agent and reactive nitrogen-containing compound used to prepare the (B)(1) reaction product are commercially available. The (B)(1) reaction product can generally be prepared by forming a mixture of the monocarboxylic acylating agent and the reactive nitrogen-containing compound at ambient to elevated temperatures of 50 to 200° C., and heating the mixture at elevated temperatures of 100 to 300° C. until the reaction product is formed in a satisfactory amount as described in the reaction procedures in columns 37 and 39 of U.S. Pat. No. 4,724,091.

In an embodiment of the invention the nitrogen-containing compound of the (B)(1) reaction product is a polyamine, an alkanolamine, a thiol-containing amine, or a mixture thereof, and the (B)(1) reaction product comprises a heterocyclic reaction product. In another embodiment of the invention the nitrogen-containing compound of the (B)(1) reaction product is a polyamine, an alkanolamine, a thiol-containing amine, or a mixture thereof, and the (B)(1) reaction product of the acylating agent and polyamine comprises a heterocyclic reaction product.

The additive composition of the present invention also comprises (B)(2) a member selected from the group consisting of (a) a hydrocarbyl-substituted aminophenol; (b) a Mannich reaction product; (c) a reaction product of a hydrocarbyl-substituted polycarboxylic acylating agent and a polyamine; and (d) a mixture thereof.

Composition (B)(2) of the additive composition can be (a) a hydrocarbyl-substituted aminophenol. The hydrocarbyl substituent of the aminophenol can have 10 to 400 carbon atoms, in another instance 30 to 180 carbon atoms, and in a further instance 10 or 40 to 110 carbon atoms. The hydrocarbyl substituent can be derived from an olefin or a polyolefin. Useful olefins include alpha-olefins, such as 1-decene, that are commercially available. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers. In another instance the hydrocarbyl-substituted aminophenol is derived from a mixture of hydrocarbyl substituents by preparing separately a hydrocarbyl-substituted aminophenol for each substituent and then mixing the separately prepared aminophenols. Useful olefin monomers include monoolefins. The monoolefins can include monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. The polyolefins can be prepared by polymerizing olefin monomers by well known polymerization methods and are also commercially available. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 95% and in other instances of 5 to 69%, 50 to 69% and 50 to 95%. The hydrocarbyl-substituted aminophenol can have one or more hydrocarbyl substituents but generally has a single hydrocarbyl substituent. The hydrocarbyl-substituted aminophenol can have one or more amino groups, in another instance can have two amino groups, and in a further instance can have a single amino group. The amino group of the aminophenol can be represented by the formula —$NH_2$. The hydrocarbyl-substituted aminophenol can be prepared by alkylating phenol with an olefin or a polyolefin, nitrating the alkylated phenol with a nitrating agent such as nitric acid, and reducing the nitrated phenol with a reducing agent such as hydrazine at temperatures of 100 to 200° C. or with a metal catalyzed hydrogenation as described in U.S. Pat. No. 4,724,091.

Composition (B)(2) of the additive composition can be (b) a Mannich reaction product of a hydrocarbyl-substituted phenol, an aldehyde, and an amine. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin as described hereinabove for the hydrocarbyl substituent of composition (B)(2)(a). The hydrocarbyl-substituted phenol can be prepared by alkylating phenol with an olefin or polyolefin such as a polyisobutylene or polypropylene using well known alkylation methods. Useful polyisobutylenes to alkylate phenol, to include polyisobutylenes containing vinylidene double bonds, are described above in the section for composition (B)(2)(a). The aldehyde of the Mannich reaction product can have 1 to 10 carbon atoms, and is generally formaldehyde or a reactive equivalent thereof such as formalin or paraformaldehyde. The amine of the Mannich reaction product can be ammonia, a monoamine, or a polyamine where the monoamine or polyamine can include alkanolamines having one or more hydroxyl groups. Useful amines include ethanolamine, diethanolamine, methylamine, dimethylamine, ethylenediamine, dimethylaminopropylamine, diethylenetriamine and 2-(2-aminoethylamino)ethanol. The Mannich reaction product can be prepared by reacting a hydrocarbyl-substituted phenol, an aldehyde, and an amine as described in U.S. Pat. No. 5,697,988. In an embodiment of this invention the Mannich reaction product is prepared from an alkylphenol derived from a polyisobutylene, formaldehyde, and an amine that is a primary monoamine, a secondary monoamine, or an alkylenediamine.

Composition (B)(2) of the additive composition can be (c) a reaction product of a hydrocarbyl-substituted polycarboxylic acylating agent and a polyamine. The hydrocarbyl substituent of the polycarboxylic acylating agent can be the same as described above for the hydrocarbyl substituent of composition (B)(2)(a). In an embodiment of the invention the hydrocarbyl substituent of the polycarboxylic acylating agent is derived from a polyisobutylene having a number average molecular weight of 140 to 5600, in a second instance of 420 to 2500, and in a third instance of 140 or 560 to 1540. In an embodiment of the invention the polyisobutylene has a vinylidene double bond content of 5 to 95% and in other instances 5 to 69%, 50 to 69%, and 50 to 95%. The hydrocarbyl-substituted polycarboxylic acylating agent can be a polyisobutenylsuccinic anhydride or a reactive equivalent thereof to include an acid, an ester, or an acid halide. The polyisobutenylsuccinic anhydride or reactive equivalent thereof can be formed by heating a mixture of a polyisobutylene and maleic anhydride or a reactive equivalent thereof at 150 to 250° C., especially when the polyisobutylene has a vinylidene content of 50% or greater, as described in U.S. Pat. No. 5,719,108. The polyisobutenylsuccinic anhydride or reactive equivalent thereof can be prepared by heating a mixture of a chlorinated polyisobutylene and maleic anhydride and/or reactive equivalent thereof or a mixture of chlorine, a polyisobutylene and maleic anhydride and/or a reactive equivalent thereof at 150 to 250° C., especially when the polyisobutylene has a vinylidene content of less than 50%, as described in U.S. Pat. No. 4,234,435. The polyamine of the (B)(2)(c) composition can be an alkylenediamine such as various ethylenediamines and propylenediamines, a polyalkylenepolyamine such as a polyethylenepolyamine to include diethylenetriamine and triethylenetetramine and pentaethylenehexamine and polyethylenepolyamine bottoms, or an alkanolamine containing two or more amine groups and one or more hydroxyl groups such as 2-(2-aminoethylamino) ethanol. The (B)(2)(c) composition can be prepared by heating a mixture of a hydrocarbyl-substituted polycarboxylic acylating agent and a polyamine such as a polyisobutenylsuccinic anhydride and a polyethylenepolyamine at 100 to 200° C. as described in U.S. Pat. No. 4,234,435.

Composition (B)(2) of the additive composition can be (d) a mixture of compositions (B)(2)(a), (B)(2)(b), and (B)(2)(c). The mixture (B)(2)(d) can be a mixture of two or more components from a single composition such as a mixture of two hydrocarbyl-substituted aminophenols from composition (B)(2)(a) where for example each aminophenol contains a different hydrocarbyl substituent. The mixture (B)(2)(d) can be a mixture of two or more components where one or more components is taken from each of two or more compositions such as a mixture of a hydrocarbyl-substituted aminophenol and a Mannich reaction product from compositions (B)(2)(a) and (B)(2)(b).

In an embodiment of the invention for a method of lubricating a two-stroke engine containing a power valve the amount of the composition (B)(1) in the lubricant composition is at least 1.2% by weight, and the amount of the compositions (B)(1) and (B)(2) combined in the lubricant composition is at least 3.5% by weight. In another embodiment of the invention the amount of the composition (B)(1) in the lubricant composition is at least 1.2% by weight, and the amount of the compositions (B)(1) and (B)(2) combined in the lubricant composition is at least 5.5% by weight. In still a further embodiments of the invention the amount of the composition (B)(1) in the lubricant composition is at least 1.6% by weight, and the amount of compositions (B)(1) and (B)(2) combined in the lubricant composition is at least 6.5 or 7.5% by weight. In other embodiments of the invention the amount of the compositions (B)(1) and (B)(2) combined in the lubricant composition can be 3.5 to 25% by weight, 5.5 to 20% by weight, and 6.5 to 15% by weight.

The lubricant composition of the method of the present invention typically also comprises a normally liquid solvent having a kinematic viscosity of less than 5 cSt (centistokes) at 100° C. and in other instances of less than 1.5 cSt and less than 1 cSt at 100° C. The solvent has physical properties such as an ASTM D-93 flash point and ASTM D-86 distillation characteristics that render it combustible. The solvent generally functions to solubilize the other components in the lubricant composition, to solubilize the lubricant composition in a liquid fuel, and to facilitate handling and transfer of the lubricant composition. The solvent can be a hydrocarbon and includes aliphatic hydrocarbons, aromatic hydrocarbons, and mixtures thereof. Hydrocarbon solvents include those obtained from petroleum such as petroleum distillates and those obtained from a synthetic source such as hydrocarbons from a Fischer-Tropsch process. Hydrocarbons for use in a two-stroke internal combustion engine are generally aliphatic hydrocarbons or aliphatic hydrocarbons containing only minor amounts of aromatic hydrocarbons, usually 3% or less by weight, since aromatic hydrocarbons tend to generate smoke when combusted. Useful hydrocarbons include aliphatic hydrocarbons or aliphatic hydrocarbons having a minor amount of aromatic hydrocarbons such as commercially available kerosenes and Stoddard solvent that boil in a 120 to 400° C. range, in another instance that boil in a 130 to 300° C. range, and in a further instance that boil in a 140 to 230° C. range. The solvent can be an oxygen-containing composition to include an alcohol, an ether, a polyether, an ester of a carboxylic acid, an aldehyde, a ketone, or a mixture thereof. The mixture can be for example a mixture of two or more alcohols or a mixture of one or more alcohols and one or more ketones. Useful oxygen-containing compositions include alcohols having 2 to 10 carbon atoms such as ethanol and isopropyl alcohol, various poly(ethylene glycol)s, and esters of a monocarboxylic acid and a polyol or of a dicarboxylic acid and an alcohol such as di-isooctyl adipate. The solvent can be a mineral oil and includes neutral distillates that are below a 200 Neutral distillate base stock. Useful mineral oils include both paraffinic and naphthenic mineral oils that are 100 Neutral or less base stocks. The solvent can be an olefin oligomer to include oligomers of alpha-olefins. Useful olefin oligomers include poly(1-decenes) and poly(1-octenes) that have a kinematic viscosity of less than 5 cSt at 100° C. In an embodiment of the invention the solvent is a hydrocarbon, an oxygen-containing composition, a mineral oil, an olefin oligomer, or a mixture thereof. The solvent mixture can be two or more components taken from a single solvent type such as for example a mixture of two kerosenes from hydrocarbons. Alternatively the solvent mixture can be two or more components where one or more components is taken from each of two or more solvent types such as for example a mixture of a kerosene and an alcohol from hydrocarbons and oxygen-containing compositions. The solvent can be present in the lubricant composition at 1 to 50% by weight and in other instances at 5 to 35% by weight and 10 to 25% by weight.

In the method of the present invention for lubricating a two-stroke internal combustion engine containing a power valve the lubricant composition improves the cleanliness of the power valve. The examples hereinbelow demonstrate the effectiveness of the method that employs the lubricant composition to improve the cleanliness of the power valve.

In the method of the present invention for lubricating a two-stroke engine containing a power valve the additive composition (B) of the lubricant composition can further comprise (3) one or more additional additives. The additional additive or additives can include detergents, dispersants, antioxidants, friction modifiers, rust inhibitors, corrosion inhibitors, antiwear agents, viscosity modifiers, lubricity agents, and antifoaming agents. Detergents can include neutral metal salts and overbased metal salts of oil soluble organic acids. Neutral metal salts generally contain about 0.5 to 1.1 equivalents of metal per equivalent of organic acid while overbased metal salts generally have greater than 1.1 equivalents of metal per equivalent of organic acid. The organic acid can include fatty carboxylic acids and alkenylsuccinic acids or anhydrides, alkylated arenesulfonic acids, oligomers of alkylphenols formed by condensation of the alkylphenol with formaldehyde or reactive equivalent thereof or with a sulfurizing agent such as sulfur, alkyl-substituted salicylic acids, condensates of an alkylphenol and glyoxylic acid or reactive equivalent thereof, condensates of an alkylphenol and formaldehyde and salicylic acid, and mixtures thereof. Methods for the preparation of neutral and overbased metal salts of organic acids are well known. Dispersants can include a reaction product of an alkenylsuccinic anhydride with a polyol such as pentaerythritol or with a combination of a polyol and an amine such as pentaerythritol and a polyethylenepolyamine as described in U.S. Pat. No. 3,381,022. Dispersants can also include a reaction product of an alkyl-substituted salicylic acid and a monoamine or a polyamine. Dispersants may also include a reaction product of a condensate of an alkylphenol and glyoxylic acid or reactive equivalent thereof with ammonia, a monoamine, or a polyamine as described in U.S. Pat. No. 5,629,448. Dispersants can include a hydrocarbyl-substituted amine such as for example the reaction product of a chlorinated polyisobutylene and ethylenediamine as described in U.S. Pat. No. 5,407,453. Antioxidants can include an alkylated diarylamine such as diphenylamine alkylated with nonenes and hindered phenols and derivatives thereof such as 2,6-di-t-butyl-4-methylphenol and condensates of 2,6-di-t-butylphenol with acrylate esters. Friction modifiers can include amides and esters of fatty carboxylic acids such as oleamide and mixtures of glycerol monooleate and glycerol dioleate. Rust inhibitors can include copolymers of alkylene oxides such as a copolymer of propylene oxide and ethylene oxide. Corrosion inhibitors can include alkenylsuccinic acids or anhydrides or derivatives thereof such as a polyisobutenylsuccinic anhydride or acid. Antiwear agents can include zinc dihydrocarbyl dithiophosphates and organic molybdenum compositions such as molybdenum dithiocarbamates. Viscosity modifiers can include a) viscosity index improvers to include polyisobutylenes, ethylene-propylene copolymers, and poly(methacrylates) and b) pour point depressants and low temperature flow improvers to include fatty alcohol esters of malan-styrene copolymers, copolymers of vinyl acetate with ethylene or fumarate esters, poly (methacrylates), olefin copolymers such as styrene-butadiene copolymers, alkylated naphthalenes, and methylene coupled alkylphenol oligomers. Lubricity agents can include bright stocks, polymers such as polyisobutylene having a number average molecular weight of 500 to 3000, vegetable oils, and esters of carboxylic acids. Antifoaming agents can include silicone oils. The amount of the additive component (B)(3) in the lubricant composition can range from 0.1 ppm by weight to 25% by weight depending on the function of the additional additive or additives. In an embodiment of the method of this invention for lubricating a two-stroke engine containing a power valve the additive composition (B) further comprises a friction modifer, an antioxidant, a pour point depressant, or a mixture thereof.

In an embodiment of the method of this invention for lubricating a two-stroke engine containing a power valve the lubricant composition is mixed with a liquid fuel, the mixture of the lubricant composition and the fuel is supplied to the engine, and the weight ratio of the fuel to the lubricant composition in the mixture is 10-250:1. The liquid fuel can be a hydrocarbon fuel, a nonhydrocarbon fuel, or a mixture thereof. The hydrocarbon fuel can be a petroleum distillate and includes a gasoline and a middle distillate fuel such as a diesel fuel and a kerosene. The gasoline can contain lead or be lead-free. Useful hydrocarbon fuels include a gasoline such as a gasoline defined by ASTM specification D4814. The nonhydrocarbon fuel can be an oxygenate and includes an alcohol such as ethanol, an ether, an organic nitro compound, a vegetable oil, or a mixture thereof. The liquid fuel can be a mixture of a hydrocarbon fuel and a nonhydrocarbon fuel and includes a mixture of a gasoline and an alcohol such as methanol or ethanol. The mixture of lubricant composition and fuel can be supplied to the engine as a premix in which the mixture is formed prior to adding it to a fuel tank of a vehicle or equipment powered by the engine. Alternatively, the mixture of the lubricant composition and fuel can be supplied to the engine via a lubricating system on the vehicle or equipment powered by the engine in which the mixture is formed by injecting the lubricant composition from the lubricating system into the fuel in a fuel system before the mixture enters a combustion chamber in a cylinder of the engine. The weight ratio of the fuel to the lubricant composition in the mixture can be 10-250:1 and in other embodiments can be 15-200:1, 25-100:1, 32:1, and 50:1. In another embodiment of the invention the lubricant composition is supplied to the engine by direct injection from a lubricating system into a combustion chamber of the engine in an amount that is equivalent to the amount of lubricant composition supplied to the engine in the above described lubricant composition-fuel mixture.

In an embodiment of the invention a lubricant composition suitable for lubricating a two-stroke internal combustion engine comprises (A) an oil of lubricating viscosity; (B) an additive comprising (1) a reaction product of a fatty hydrocarbyl-substituted monocarboxylic acylating agent and a polyamine, an alkanolamine, a thiol-containing amine, or a mixture thereof wherein the reaction product comprises a heterocyclic reaction product; and (2) a hydrocarbyl-substituted aminophenol; and (C) a normally liquid solvent having a kinematic viscosity of less than 5 cSt at 100° C. wherein the amount of the composition (B)(1) is greater than 3.4% by weight, and the amount of compositions (B)(1) and (B)(2) combined is greater than 9.6% by weight. In another embodiment of the invention composition (B)(1) can be present in the lubricant composition at greater than 4% by weight while the combination of compositions (B)(1) and (B)(2) can be present at greater than 10.2% by weight. In a further embodiment of this invention composition (B)(1) is present in the lubricant composition at greater than 5 or 6% by weight while the combination of compositions (B)(1) and (B)(2) is present at greater than 10.2% by weight. This lubricant composition containing the component (B)(1) heterocyclic reaction product and the component (B)(2) aminophenol is unexpectedly very effective in improving the cleanliness of a power valve of a two-stroke engine as demonstrated in the examples hereinbelow. In the lubricant composition for lubricating a two-stroke engine, the oil of lubricating viscosity, the additive composition comprising the (B)(1) reaction product comprising a heterocyclic reaction product and the (B)(2) aminophenol, and the solvent are described above for the method of lubricating a two-stroke engine containing a power valve. In an embodiment of the invention the (B)(1) reaction product, used in the lubricant for lubricating a two-stroke engine, is a reaction product of a hydrocarbyl-substituted acylating agent and a polyamine, in another instance the (B)(1) reaction product is a reaction product of a $C_4$ to $C_{22}$ fatty carboxylic acid and a polyamine to include an alkylenediamine or a polyalkylenepolyamine, and in a further instance the (B)(1) reaction product is a reaction product of isostearic acid and a polyethylenepolyamine. In another embodiment of the invention the lubricant composition for a two-stroke engine comprises an oil of lubricating viscosity that is a natural oil, a synthetic oil, or a mixture thereof. In an embodiment of this invention the lubricant composition for the two-stroke engine comprises an additive composition where the hydrocarbyl substituent of the (B)(2) hydrocarbyl-substituted aminophenol is derived from a polyisobutylene, and in a further embodiment the polyisobutylene has 40 to 110 carbon atoms. In another embodiment of the invention the lubricant composition for a two-stroke engine comprises (C) a solvent that is a hydrocarbon, an oxygen-containing composition, a mineral oil, an olefin oligomer, or a mixture thereof, and in a further embodiment the solvent is a kerosene, Stoddard solvent, or a mixture thereof. In a further embodiment of the invention for the lubricant composition for a two-stroke engine, an additive composition of the lubricant composition further comprises (B)(3) one or more additional additives, and in another embodiment the additive composition further comprises a diarylamine antioxidant, glycerol monooleate or a mixture of glycerol monooleate and glycerol dioleate friction modifiers, a propylene oxide-ethylene oxide copolymer rust inhibitor, or a mixture thereof. An embodiment of the invention is a fuel composition for fueling a two-stroke engine comprising a liquid fuel, as described hereinabove for a method of lubricating a two-stroke engine containing a power valve, and a lubricating amount of the lubricant composition for a two-stroke engine, and in a further embodiment the fuel composition comprises a liquid fuel that is a lead free gasoline. An embodiment of the invention is a method for lubricating a two-stroke internal combustion engine comprising supplying to the engine the lubricant composition for a two-stroke engine. A further embodiment of this invention is a method for lubricating a two-stroke internal combustion engine comprising supplying to the engine a fuel composition containing the lubricant composition for a two-stroke engine.

Lubricant compositions, mixtures of lubricant compositions and fuels, and fuel compositions of this invention can be prepared by mixing or admixing the components of the composition or mixture in proportions at ambient to elevated temperatures of 80° C. in any order or fashion that results in a composition or mixture in which the components are miscible initially and over extended periods of time encountered in storage conditions. The lubricant composition is usually prepared by mixing the oil of lubricating viscosity with the additive composition or with the additive components of the additive composition added in various orders separately or in various combinations at ambient to elevated temperatures followed by addition with mixing of the solvent generally at ambient temperature. The lubricant composition-fuel mixture or fuel composition is usually prepared at ambient temperature by admixing the liquid fuel and the lubricant composition either as a premix prior to adding the mixture or composition to the fuel tank of a two-stroke engine or in a two-stroke engine by injection of the lubricant composition from a lubricating system into the fuel in a fuel system.

The following examples demonstrate the effectiveness of the methods and lubricant and fuel compositions of the present invention in improving the cleanliness of power valves of a two-stroke internal combustion engine. The examples are provided for illustrative purposes only and are not intended to limit the scope of the invention.

1996 Model 125 Yamaha Engine Testing[a].

| Example[b] | Additive (B)(1) ISTA-TEPA, Wt % in lubricant | Additive (B)(2), wt % in lubricant | Power Valve Rating[k] |
|---|---|---|---|
| 1[c] (comparative) | — | 4.5 (PIBSA dispt) | 2.1 |
| 2[d] (comparative) | — | — | 3.5 |
| 3[e] | 1.2 | 6.6 (aminophenol) | 3.1 |
| 4[f] | 3 | 6.6 (aminophenol) | 3.8 |
| 5[g] (comparative) | 1.15 | 7.2 (aminophenol + PIBSA dispt) | 2.8 |
| 6[h] | 2 | 7.4 (Mannich) | 4.6 |
| 7[i] | 6 | 5.6 (PIBSA dispt) | 3.4 |
| 8[j] | 6 | 4.8 (aminophenol) | 4.3 |

[a]1996 model 125 Yamaha 124 $cm^3$ two-stroke, liquid-cooled racing engine containing power valves was run on a premix fuel to lubricant ratio of 50:1 by volume for 12.7 hours using an Eddy current dynamometer system to control engine speed and load at a coolant outlet temperature of 96° C.

[b]The lubricant in Examples 1 and 3 to 8 consisted of 67 to 76% by wt. mineral oil that was a mixture of 600 Neutral and 150 Bright Stock base oils, 15% by wt. Stoddard solvent, and 9 to 18% by wt. of an additive composition or package that included diluent oil.

[c]The lubricant of Example 1 contained 1) 4.5% by wt. of a dispersant (PIBSA dispt) from the reaction of a polyisobutenylsuccinic anhydride, derived from a 1000 mol. wt. polyisobutylene, and polyethylenepolyamines, derived from a mixture of bottoms and diethylenetriamine, in a ratio of 4 carbonyl groups to 3 nitrogen groups and 2) 0.6% by wt. of a detergent that was a calcium salt of a sulfur coupled oligomer of dodecylphenol.

[d]The lubricant of Example 2 was a commercial synthetic lubricant of unknown composition intended for use in two-stroke engines containing exhaust port or power valves.

[e]The lubricant of Example 3 contained 1) 1.2% by wt. of an additive (ISTA-TEPA) from the reaction of isostearic acid and tetraethylenepentamine in a ratio of 1 acid group to 1.5 nitrogen groups, 2) 6.6% by wt. of an additive that was a substituted aminophenol prepared by alkylating phenol with 1000 mol. wt. polyisobutylene and then nitrating the alkylated phenol with nitric acid and reducing the nitrated alkylated phenol with hydrazine, 3) 0.3% by wt. of a detergent that was a calcium salt of a methylene coupled oligomer of heptylphenol, 4) 1% by wt. of a diarylamine antioxidant and 5) 0.3% by wt. of the friction modifier glycerol monooleate.

[f]The lubricant of Example 4 contained 1) 3% by wt. of the isostearic acid-tetra-ethylenepentamine reaction product described in footnote e above, 2) 6.6% by wt. of the substituted aminophenol described in footnote e above, 3) 0.9% by wt. of the detergent derived from heptylphenol and described in footnote e above, 4) 1% by wt. of a diarylamine antioxidant and 5) 0.3% by wt. of the friction modifier glycerol monooleate.

[g]The lubricant of Example 5 contained 1) 1.15% by wt. of the isostearic acid-tetra-ethylenepentamine reaction product described in footnote e above, 2) 5.9% by wt. of the substituted aminophenol described in footnote e above, 3) 1.3% by wt. of a dispersant from the reaction of a polyisobutenylsuccinic anhydride, derived from 1000 mol. wt. polyisobutylene, and polyethylenepolyamines, derived from a mixture of bottoms and diethylenetriamine, in a ratio of 1 carbonyl group to 1.1 nitrogen groups and 4) 0.2% by wt. of a diarylamine antioxidant.

[h]The lubricant of Example 6 contained 1) 2% by wt. of the isostearic acid-tetra-ethylenepentamine reaction product described in footnote e above, 2) 7.4% by wt. of a Mannich reaction product from the reaction of phenol alkylated with 1000 mol. wt. high vinylidene content polyisobutylene, formaldehyde and dimethylamine, 3) 0.5 % by wt. of the friction modifier glycerol monooleate and 4) 0.15% by wt. of a pour point depressant that was a methacrylate copolymer.

[i]The lubricant of Example 7 contained 1) 6% by wt. of the isostearic acid-tetra-ethylenepentamine reaction product described in footnote e above, 2) 5.6% by wt. of a dispersant from the reaction of a polyisobutenylsuccinic anhydride, derived from 1000 mol. wt. polyisobutylene, and tetraethylenepentamine in a ratio of 1 carbonyl group to 2.1 nitrogen groups, 3) 1% by wt. of a diarylamine antioxidant, 4) 0.3% by wt. of the friction modifier glycerol monooleate and 5) 0.06% by wt. of a rust inhibitor that was a copolymer of propylene oxide and ethylene oxide.

[j]The lubricant of Example 8 contained 1) 6% by wt. of the isostearic acid-tetra-ethylenepentamine reaction product described in footnote e above, 2) 4.8% by wt. of the substituted aminophenol described in footnote e above, 3) 1% by wt. of a diarylamine antioxidant, 4) 0.3% by wt. of the friction modifier glycerol monooleate and 5) 0.06% by wt. of a rust inhibitor that was a copolymer of propylene oxide and ethylene oxide.

[k]The power valve rating was based on the CRC (Coordinating Research Council) rating manual and was an average of the ratings for the set of right and left power valves with higher ratings indicating cleaner valves and better lubricant performance.

Each of the documents referred to in this Detailed Description of the Invention section is incorporated herein by reference. All numerical quantities in this application used to describe or claim the present invention are understood to be modified by the word "about" except for the examples or where explicitly indicated otherwise. All chemical treatments or contents throughout this application regarding the present invention are understood to be as actives unless indicated otherwise even though solvents or diluents may be present.

What is claimed is:

1. A method for lubricating a two-stroke internal combustion engine containing a power valve, comprising:

(I) mixing a lubricant composition with a fuel composition wherein the weight ratio of the fuel to the lubricant composition in the mixture is 25-100:1; and (II) supplying said mixture to a two-stroke internal combustion engine containing a power valve;

wherein the lubricant composition comprises:

(A) an oil of lubricating viscosity;

(B) an additive composition comprising (1) a reaction product of a fatty hydrocarbyl-substituted monocarboxylic acylating agent and a polyamine, wherein the monocarboxylic acylating agent comprises tall oil fatty acids, oleic acid, stearic acid or isostearic acid, wherein the polyamine comprises alkylenediamines, N-alkyl alkylenediamines, or polyalkylenepolyamines, and wherein the reaction product comprises a heterocyclic reaction product wherein the reaction product is present in the overall composition at about 2 percent by weight; and (2) a Mannich reaction product of a hydrocarbyl-substituted phenol, an aldehyde, and an amine wherein the Mannich reaction product is present in the overall composition at no more than 7.4 weight percent on an actives basis; and (3) a friction modifier component comprising glycerol monooleate or a mixture of glycerol monooleate and glycerol dioleate friction modifiers wherein the friction modifier component is present in the overall composition from about 0.3 to about 0.5 percent by weight; and (C) a normally liquid solvent having a kinematic viscosity of less than 5 cSt at 100° C. wherein the lubricant composition improves the cleanliness of the power valve of said engine, wherein the solvent is present from 1 to 50 percent by weight of the lubricant and has an ASTM D-93 flashpoint and ASTM D-86 distillation characteristics rendering it combustible;

wherein all weight percent values are on an actives basis; and wherein the fuel comprises a petroleum distillate fuel, an oxygenate, or a mixture thereof.

2. The method of claim 1 wherein the oil of lubricating viscosity is a natural oil, a synthetic oil, or a mixture thereof.

3. The method of claim 1 wherein the oil of lubricating viscosity is present in the lubricant composition at 30 to 95% by weight.

4. The method of claim 1 wherein the fatty carboxylic acid is isostearic acid and the polyamine is a polyethylenepolyamine.

5. The method of claim 1 wherein the Mannich reaction product (B)(2) is prepared from an alkylphenol derived from a polyisobutylene, formaldehyde, and an amine that is a primary monoamine, a secondary monoamine, or an alkylenediamine.

6. The method of claim 1 wherein the solvent is a hydrocarbon, an oxygen-containing composition, a mineral oil, an olefin oligomer, or a mixture thereof.

7. The method of claim 1 wherein the additive composition (B) further comprises one or more additional additives.

8. The method of claim 1 wherein the additive composition (B) further comprises one or more additional additives selected from the list consisting of an antioxidant, a pour point depressant, or a mixture thereof.

* * * * *